US006679744B2

(12) United States Patent
Hatada

(10) Patent No.: US 6,679,744 B2
(45) Date of Patent: Jan. 20, 2004

(54) METHOD AND APPARATUS FOR ASSEMBLING ELECTRON GUN

(75) Inventor: Izuho Hatada, Kanagawa (JP)

(73) Assignee: Sony Corporation (JP)

( * ) Notice: Subject to any disclaimer, the term of this patent is extended or adjusted under 35 U.S.C. 154(b) by 301 days.

(21) Appl. No.: 09/796,706

(22) Filed: Mar. 2, 2001

(65) Prior Publication Data

US 2001/0019932 A1 Sep. 6, 2001

(30) Foreign Application Priority Data

Mar. 6, 2000 (JP) ..... P2000-059849

(51) Int. Cl.[7] ..... H01J 9/18
(52) U.S. Cl. ..... 445/3; 445/4; 445/63
(58) Field of Search ..... 445/3 R, 3 A, 445/63, 34

(56) References Cited

U.S. PATENT DOCUMENTS 4,148,117 A * 4/1979 Bracke et al. ..... 445/34
4,189,814 A * 2/1980 Ottos ..... 445/34
5,730,064 A * 3/1998 Bishop ..... 105/168
5,749,760 A * 5/1998 Kimura et al. ..... 445/34

FOREIGN PATENT DOCUMENTS

EP 0 244 826 11/1987
EP 0 793 250 9/1997
JP 60 49540 3/1985
JP 10 321131 12/1998

* cited by examiner

*Primary Examiner*—Kenneth J. Ramsey
(74) *Attorney, Agent, or Firm*—Rader, Fishman & Grauer PLLC; Ronald P. Kananen

(57) ABSTRACT

Disclosed is an electron gun assembling method used for assembling a first electrode having a plurality of beam apertures as opposed to one cathode used as an electron beam emitting source with a cathode structure having the cathode. The method includes: a first step of rotating the cathode structure on its axis in a state in which the cathode structure is opposed to the first electrode, and measuring, during rotation of the cathode structure, a distance between each of the beam apertures of the first electrode and a beam emission plane of the cathode; and a second step of setting a rotational position of the cathode structure on the basis of the result measured in the first step. In the second step, particularly, the rotational position of the cathode structure may be set under a condition that the maximum one of the differences between the distances from the beam apertures of the first electrode to the beam emission plane of the cathode is minimized. With this assembling method, it is possible to reduce a variation in operational characteristics of the electron gun, such as a cutoff characteristic.

4 Claims, 7 Drawing Sheets

METHOD AND APPARATUS FOR ASSEMBLING ELECTRON GUN

BACKGROUND OF THE INVENTION

The present invention relates to a method and an apparatus for assembling an electron gun, particularly, suitable for assembling a first electrode, which has a plurality of beam apertures as opposed to one cathode used for an electron beam emission source, with a cathode structure having the cathode.

A so-called inline type electron gun is configured to emit a plurality of electron beams arranged in line in the horizontal direction.

To emit electron beams in line, the inline type electron gun includes cathodes arranged in line and a first electrode opposed to the cathodes.

The first electrode has beam apertures at positions opposed to the cathodes arranged in line.

FIG. 1A is a sectional view showing a cathode and its neighborhood of an electron gun; FIG. 1B is a plan view, seen in the direction from a first electrode to the cathode, showing the first electrode.

Referring to FIG. 1A, there is shown a cathode structure 3 including a cathode 1 and a cylindrical body 2 (hereinafter, referred to as "sleeve"). The sleeve 2 holds at its leading end portion the cathode 1 and contains a heater for heating the cathode 1.

The cathode structure 3 is held on a sleeve holder 4.

The sleeve holder 4 is fixed to a fixing member 5 made from an insulator.

While not shown, an outer peripheral portion of the fixing member 5 is mechanically fixed to an outer peripheral portion of a first electrode 6.

That is to say, the cathode structure 3 is assembled with the first electrode 6 via the fixing member 5.

In the electron gun, the first electrode 6 is integrated with a second electrode 7 adjacent thereto and other electrodes (not shown) by means of bead glass.

In general, an electron gun used for a color cathode ray tube includes three cathode structures 3 corresponding to three primary colors of light, that is, red, green, and blue.

Referring to FIG. 1B, there is shown the first electrode 6, which generally has only one aperture for allowing an electron beam to pass therethrough, that is, only one beam aperture 8 as opposed to one cathode 1.

In some cases, however, there is used an electron gun of a type including a first electrode having a plurality of beam apertures as opposed to a single cathode.

The electron gun of this type is allowed to derive a plurality of electron beams from the single cathode.

As a result, the electron gun of this type is advantageous in forming electron beams with a high current density within an electron emission ability of the single cathode and reducing a drive voltage of the cathode.

In the electron gun of this type, a plurality of beam apertures are present as opposed to the single cathode.

Accordingly, a variation in distance between each beam aperture of the first electrode and a beam emission plane of the cathode exerts an adverse effect on characteristics of the electron gun, such as a cutoff characteristic, a drive characteristic, and crossover of electron beams.

To solve such a problem, it is required to make distances between the beam apertures of the first electrode and the beam emission plane of the cathode as equal to each other as possible.

In the existing process of assembling an electron gun, a cathode holding member, including a sleeve holder and a fixing member, is assembled with a first electrode.

Subsequently, a cathode structure obtained by assembling a cathode with a sleeve is inserted in the cathode holding member and is fixed thereto by welding or the like.

In assembling the cathode structure, however, the cathode may be sometimes assembled with the sleeve in a tilting state due to a dimensional error of the cathode and a dimensional error of the sleeve.

Further, in inserting the cathode structure in the cathode holding member, the cathode may sometimes be inserted in the cathode holding member in a tilting state because a specific clearance must be ensured therebetween.

Accordingly, when the cathode structure is assembled with the first electrode, the degree of parallelization between the cathode structure and the first electrode may be sometimes degraded.

As a result, distances between the beam apertures of the first electrode and the single cathode may be uneven, causing a variation in operational characteristics of the electron gun, such as the cutoff characteristic and the drive characteristic.

SUMMARY OF THE INVENTION

An object of the present invention is to provide a method and an apparatus for assembling an electron gun including a first electrode having a plurality of beam apertures as opposed to one cathode, which are capable of equalizing distances between the beam apertures of the first electrode and a beam emission plane of the cathode.

To achieve the above object, according to a first aspect of the present invention, there is provided an electron gun assembling method used for assembling a first electrode having a plurality of beam apertures as opposed to one cathode used as an electron beam emitting source with a cathode structure having the cathode, the method including: a first step of rotating the cathode structure on its axis in a state in which the cathode structure is opposed to the first electrode, and measuring, during rotation of the cathode structure, a distance between each of the beam apertures of the first electrode and a beam emission plane of the cathode; and a second step of setting a rotational position of the cathode structure on the basis of the result measured in the first step.

In the above-described second step, preferably, the rotational position of the cathode structure is set under a condition that the maximum one of the differences between the distances from the beam apertures of the first electrode to the beam emission plane of the cathode is minimized.

According to a second aspect of the present invention, there is provided an electron gun assembling apparatus used for assembling a first electrode having a plurality of beam apertures as opposed to one cathode used as an electron beam emission source with a cathode structure having the cathode, the apparatus including: first holding means for holding the first electrode; second holding means for holding the cathode structure in a state in which the cathode structure is opposed to the first electrode held by the first holding means; rotating means for rotating the cathode structure held by the second holding means on its axis; measuring means for measuring, during rotation of the cathode structure by the rotating means, a distance between each of the beam apertures of the first electrode and a beam emission plane of the cathode; and setting means for setting a rotational position of the cathode structure on the basis of the result measured by the measuring means.

The above-described setting means preferably sets the rotational position of the cathode structure under a condition that the maximum one of the differences between the distances from the beam apertures of the first electrode to the beam emission plane of the cathode is minimized.

According to the above-described method and apparatus of the present invention, it is possible to equalize distances between beam apertures of a first electrode and a beam emission plane of a cathode, and hence to form electron beams with a high current density and reduce a drive voltage of the cathode while reducing a variation in operational characteristics such as a cutoff characteristic and a drive characteristic of the electron gun.

DETAILED DESCRIPTION OF A PREFERRED EMBODIMENT

Hereinafter, one embodiment of the present invention will be described in detail with reference to the accompanying drawings.

Figure 1A:
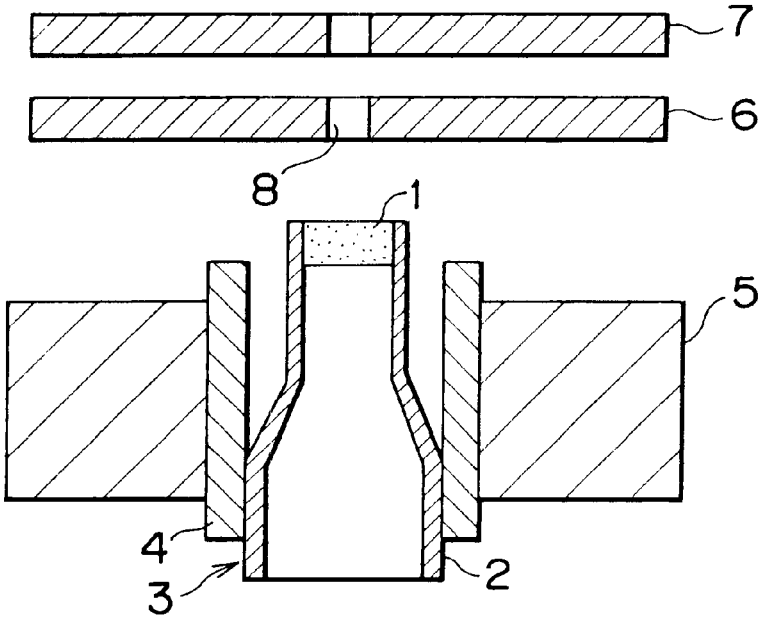
FIG. 1A is a sectional view, taken on a plane containing an axis of a cylindrical sleeve, showing a structure of a cathode and its neighborhood of an electron gun.
Figure 1B:
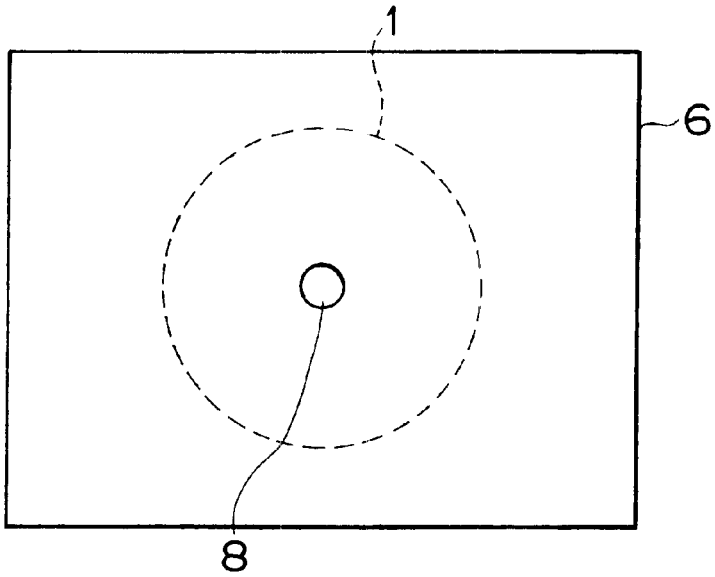
FIG. 1B is a plan view of a first electrode, seen along the direction from the first electrode to the cathode, showing a positional relationship between a beam aperture provided in the first electrode and the cathode.

In this embodiment, parts corresponding to those of the related art electron gun described with reference to FIGS. 1A and 1B are designated by the same reference numerals.

Figure 2:
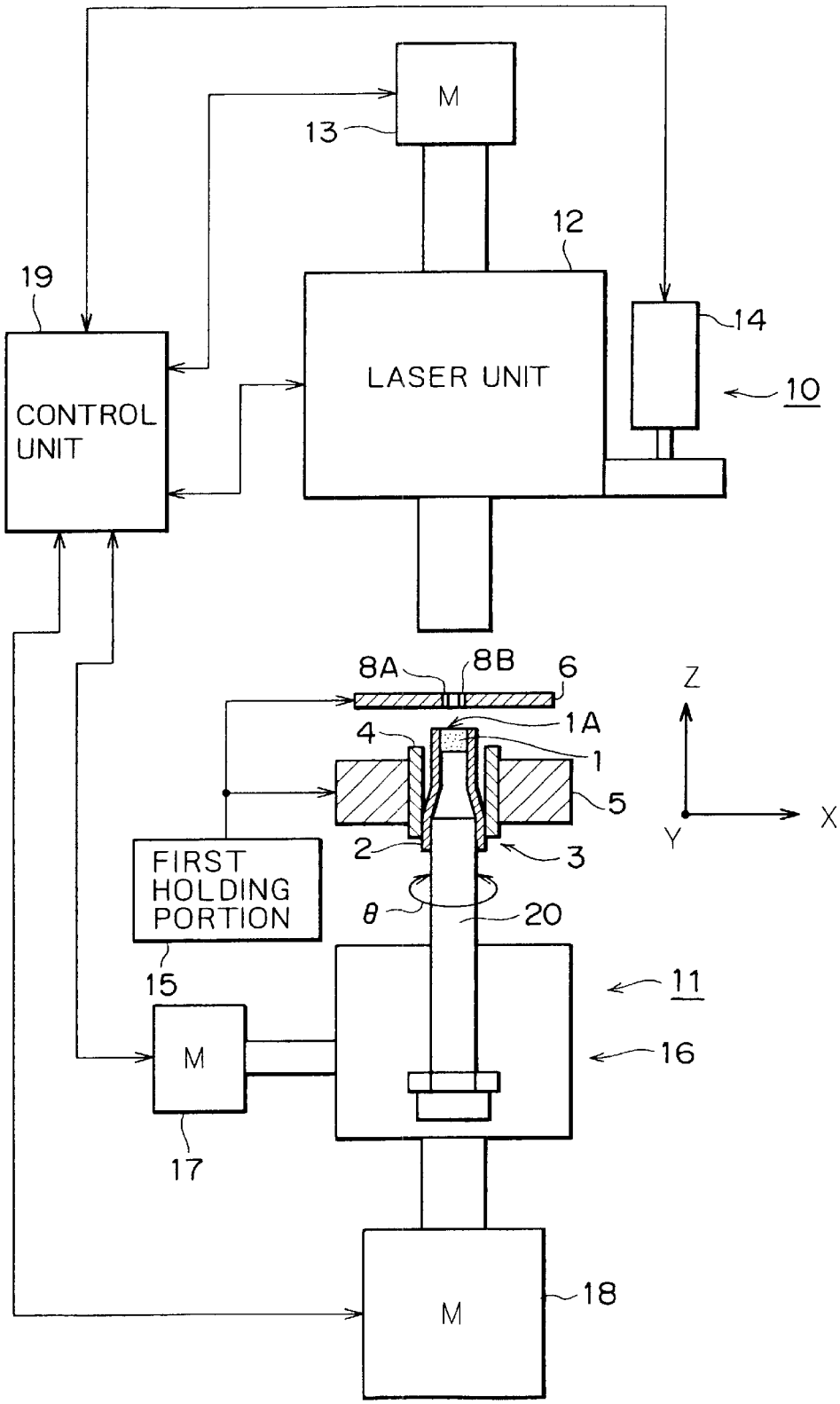
FIG. 2 is a schematic view showing an electron gun assembling apparatus according to an embodiment of the present invention.

FIG. 2 is a schematic view showing an electron gun assembling apparatus according to the embodiment of the present invention.

Referring to FIG. 2, there are shown a distance measuring mechanism unit 10 and a holding mechanism unit 11, which are oppositely disposed on the upper and lower sides, respectively.

The distance measuring mechanism unit 10 mainly includes a laser unit 12, a motor 13 for movement up/down, and a length measuring machine 14.

The holding mechanism unit 11 includes a first holding portion 15, a second holding portion 16, a motor 17 for rotation, and a motor 18 for movement up/down.

A control unit 19 is used to control the operation of the entire apparatus on the basis of a predetermined program.

The laser unit 12, the motor 13 for movement up/down, the length measuring machine 14, the motor 17 for rotation, and the motor 18 for movement up/down are electrically connected to the control unit 19.

The laser unit 12 and the length measuring machine 14 constitute measuring means of the present invention.

The laser unit 12 is supported by a supporting mechanism (not shown) in such a manner as to be movable in the vertical direction, that is, the Z-direction in the figure.

The laser unit 12 can be moved up or down by the motor 13 for movement up/down.

A laser emitting portion and a laser receiving portion of the laser unit 12 are supported by an X-Y drive stage (not shown).

The laser emitting portion and the laser receiving portion thus supported by the X-Y drive stage can be moved from right to left in the figure, that is, in the X-direction and from back to front of the paper plane in the figure, that is, in the Y-direction in the figure.

The laser unit 12 emits a laser ray to a specific object, that is, to the first electrode 6 and the cathode 1 in this embodiment.

On the basis of the laser ray reflected from the object, the laser unit 12 is moved up or down by the motor 13 for movement up/down via the control unit 19.

With the movement up or down of the laser unit 12, the laser ray is focused on a laser irradiation plane of the object.

The length measuring machine 14 mounted on a portion near the laser unit 12 is used to measure a distance from a reference position of the device 14 to the object irradiated with the laser ray on the basis of the movement up or down of the laser unit 12 for focusing the laser ray on the object.

The measured result of the length measuring machine 14 is supplied to the control unit 19.

The distance measurement method using a laser ray is not limited to that described above. For example, there may be adopted a method of emitting a pulse laser from a measuring machine to an object and measuring a distance between the measuring machine and the object on the basis of a time elapsed until the laser light is reflected from the object to be returned to the measuring machine.

The measuring machine called a "laser distance meter" is used for the above measurement method.

The first holding portion 15 is used for holding the first electrode 6, which portion constitutes a first holding means of the present invention.

To be more specific, the first holding portion 15 holds the first electrode 6, together with the sleeve holder 4 and the fixing member 5, in the horizontal state by using, for example, an openable/closable clamper.

The sleeve holder 4 and the fixing member 5 are previously assembled into an assembly, and then the assembly is held by the first holding portion 15.

The second holding portion 16 is used for holding the cathode structure 3 including the cathode 1 and the sleeve 2, which portion constitutes a second holding means of the present invention.

The second holding portion 16 has at its leading end (upper end) a bar-like receiving member 20 for receiving the sleeve 2 of the cathode structure 3.

The receiving member 20 is supported by a supporting mechanism (not shown), in such a manner as to be movable in the vertical direction.

The receiving member 20 has a circular cross-sectional shape corresponding to a sectional shape of the sleeve 2.

An outside diameter of the receiving member 20 is set to be slightly smaller than an inside diameter of a rear end portion, on the side opposed to a cathode mounting portion, of the sleeve 2.

Accordingly, the leading end of the receiving member 20 is insertable in the sleeve 2.

The motor 17 for rotation is used for rotating the receiving member 20 in the direction θ via a power conversion mechanism (not shown) such as a belt transmission mechanism, or a gear transmission mechanism, which motor constitutes rotating means of the present invention in combination with the power conversion mechanism.

The motor 18 for movement up/down is used for moving up or down the receiving member 20 vertically movably supported by a supporting mechanism (not shown).

The distance between the first electrode 6 and the cathode structure 3 opposed to each other is adjusted by moving up or down the receiving member 20.

Figure 3:
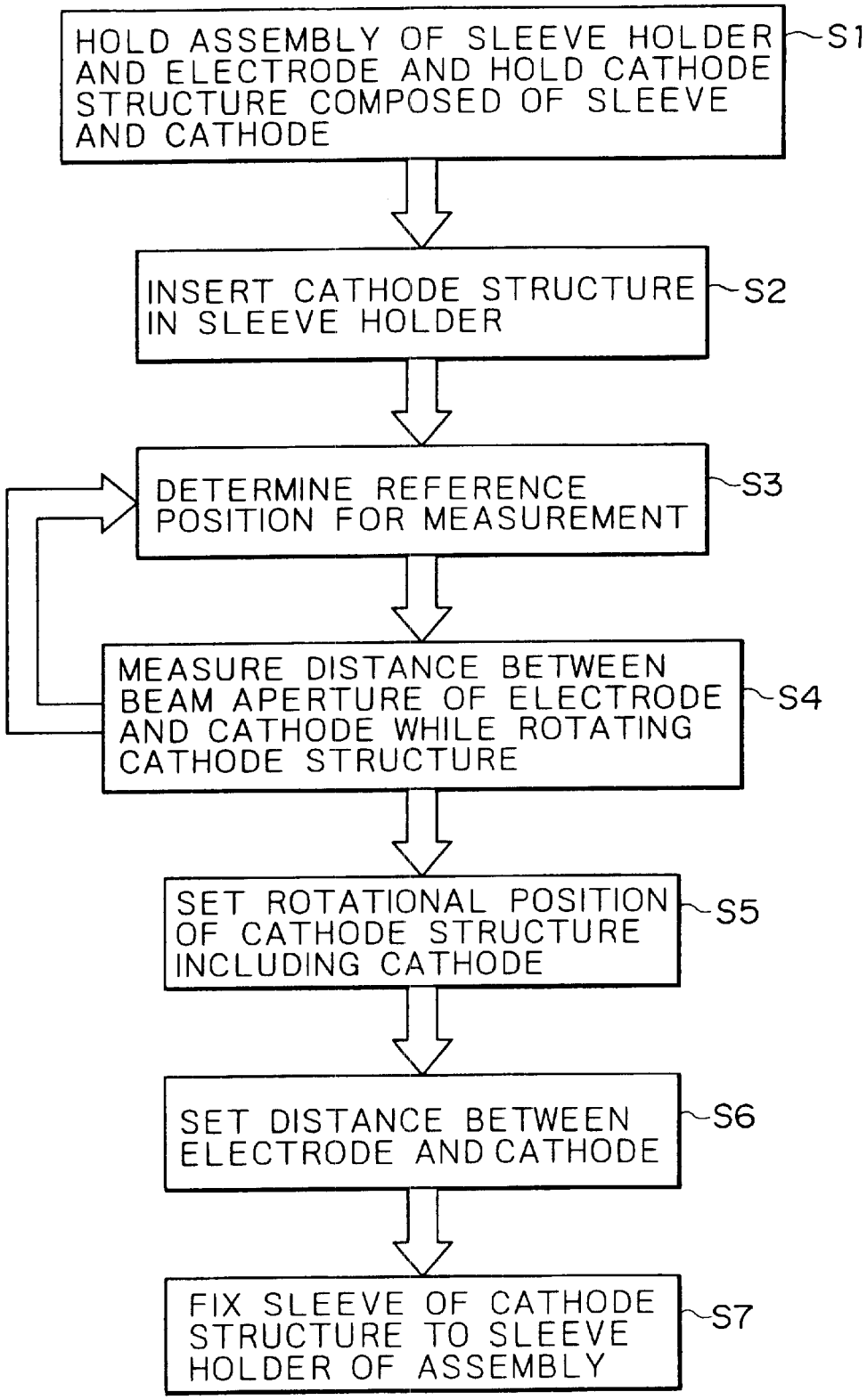
FIG. 3 is a flow chart showing steps of an electron gun assembling method according to an embodiment of the present invention.

The operation of the electron gun assembling apparatus on the basis of commands supplied from the control unit 19 will be described below with reference to a flow chart shown in FIG. 3.

Figure 4:
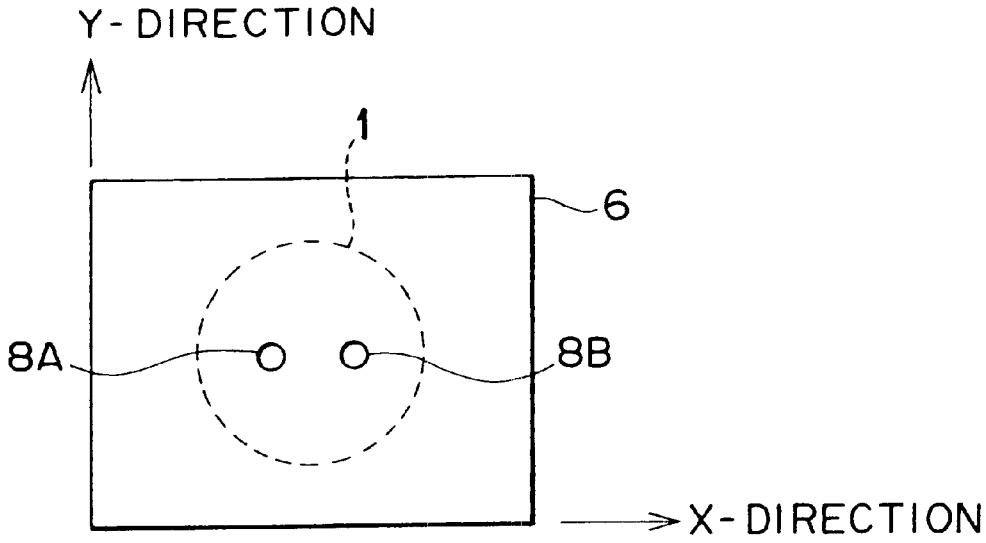
FIG. 4 is a plan view of a first electrode, seen along the direction from the first electrode to the cathode, showing a positional relationship between two beam apertures provided in the first electrode and the cathode.

In addition, a description of the operation of the apparatus of the present invention will be shown by an example of a first electrode having two beam apertures as opposed to one cathode 1 as shown in FIGS. 2 and 4.

To be more specific, the first electrode 6 adopted for the following description has, as shown in FIG. 4, two beam apertures 8A and 8B formed at positions equally separated from the center of the cathode 1 in the crosswise direction, that is, the X-direction in the figure.

The cathode structure 3 used for the following description is of a type having an integral sleeve 2.

The present invention, however, is applicable to an electron gun adopting a cathode structure of a type having a twice-divided sleeve.

First, in step S1, an assembly composed of the sleeve holder 4, the fixing member 5, and the first electrode 6 is held by the first holding portion 15, and the cathode structure 3 is held by the second holding portion 16 by inserting the rear end portion of the sleeve 2 in the leading end portion of the receiving member 20.

At this time, the cathode structure 3 set on the receiving member 20 is in a state of being retreated downwardly from the position at which the assembly is held by the first holding portion 15.

In step S2, the receiving member 20 is moved up by driving the motor 18 for movement up/down on the basis of a command supplied from the control unit 19, whereby the cathode structure 3 is inserted in the sleeve holder 4 as shown in FIG. 2.

At this time, the vertical position, that is, the height of the cathode 1, is adjusted such that a distance between the cathode 1 and the first electrode 6 is larger than a predetermined reference distance.

In step S3, a reference position for measurement of a distance between the cathode 1 and the first electrode 6 (which will be described later) is determined.

The determination of the reference position for measurement is performed for one of the two beam apertures 8A and 8B provided in the first electrode 6, for example, the beam aperture 8A.

Figure 5:
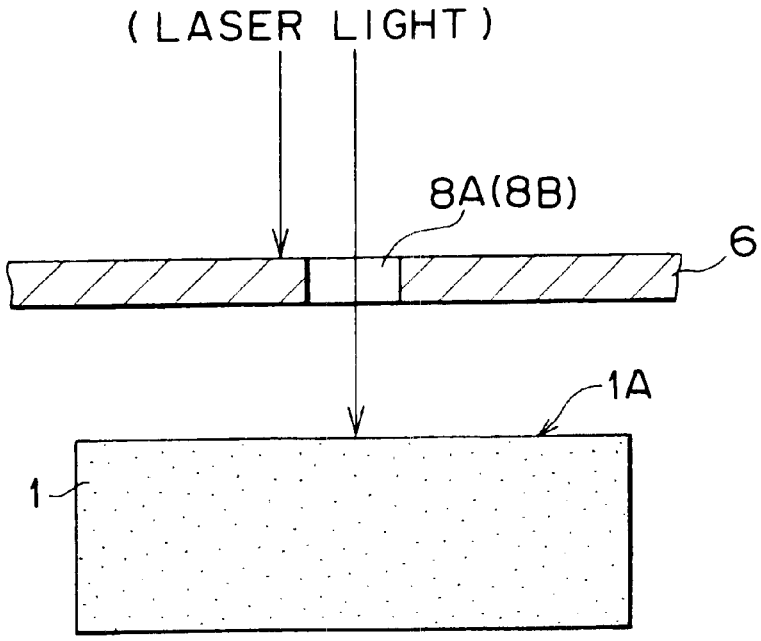
FIG. 5 is a view illustrating a method of measuring a distance between one of the two beam apertures of the first electrode shown in FIG. 4 and an electron emission plane of the cathode.

First, as shown in FIG. 5, a position, near the beam aperture 8A, of the upper surface of the first electrode 6 is irradiated with a laser ray emitted from the laser unit 12.

Subsequently, the laser ray emitted from the laser unit 12 is adjusted to be focused on the above portion of the upper surface of the first electrode 6 by moving up or down the laser unit 12 by means of operation of the motor 13 for movement up/down.

The determination of the reference position for measurement is performed by resetting, in such a state, a measured value of the length measuring machine 14.

The position of the upper surface of the first electrode 6 irradiated with the laser ray is then adjusted to correspond to a position of the beam aperture 8A by the X-Y drive stage (not shown).

With this adjustment, as shown in FIG. 5, upon the start of rotation of the receiving member 20, a portion, of a beam emission plane 1A of the cathode 1 directly under the beam aperture 8A is irradiated with the laser ray which has been emitted from the laser unit 12 and has passed through the beam aperture 8A.

The motor 17 for rotation is driven on the basis of a command supplied from the control unit 19, to rotate the receiving member 20 in the direction θ.

In step S4, during rotation of the receiving member 20, a distance between the beam aperture 8A of the first electrode 6 and the beam emission plane 1A of the cathode 1 is measured by using the laser unit 12.

At this time, the cathode structure 3 is rotated on its axis, together with the receiving member 20, by rotation of the receiving member 20.

During rotation of the receiving member 20, the position of the laser unit 12 is automatically adjusted such that the laser ray emitted from the laser unit 12 is focused on the upper surface of the cathode 1.

In this way, a distance between the reference position of the length measuring machine 14 and the beam emission plane 1A of the cathode 1 is measured by the length measuring machine 14.

The measured distance thus obtained is the distance between the two positions irradiated with the laser ray shown in FIG. 5, that is, the distance between the portion of the upper surface of the first electrode 6 near the beam aperture 8A and the beam emission plane 1A of the cathode 1, which distance is substantially equivalent to the distance between the beam aperture 8A and the beam emission plane 1A. The distance data are supplied from the length measuring machine 14 to the control unit 19.

Here, if the motor 17 for rotation is configured as a pulse motor or a motor with an encoder, a rotational angle of the cathode structure 3 in the direction θ can be determined by counting drive pulses for driving the pulse motor or pulse signals from the encoder by the control unit 19.

With this configuration, the measured distance data supplied from the length measuring machine 14 can be stored in a memory of the control unit 19 in such a manner as to correspond with the rotational angle information of the cathode structure 3.

Figure 6A:
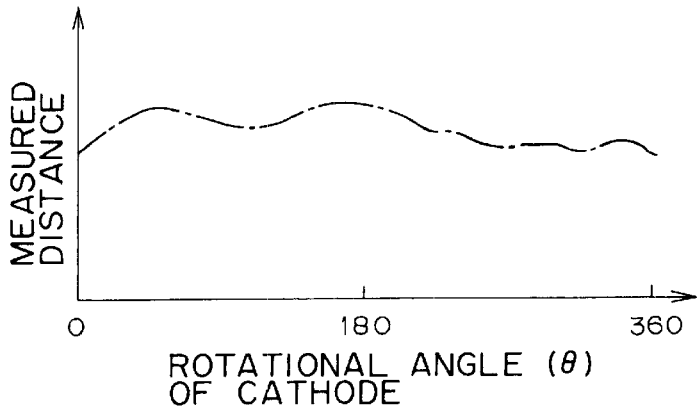
FIG. 6A is a graph showing a change in distance between one of the two beam apertures and the cathode shown in FIG. 5, wherein the ordinate indicates the distance and the abscissa indicates the rotational angle of the cathode.

FIG. 6A is a graph showing one example of the measurement information stored in the control unit 19, in which the ordinate indicates the measured distance obtained by the length measuring machine 14 and the abscissa indicates the rotational angle of the cathode 1.

As is apparent from the figure, the distances are measured by the length measuring machine 14 continuously or with a specific rotational angle pitch in a rotational angle range equivalent to one-turn, that is, a turn by 360° of the cathode structure 3 (that is, the cathode 1) with a specific rotational angle position taken as a reference, that is, zero.

The same procedure (steps S3 and S4) is then repeated for the other beam aperture 8B, to measure a distance between the beam aperture 8B and the beam emission plane 1A of the cathode 1.

Figure 6B:
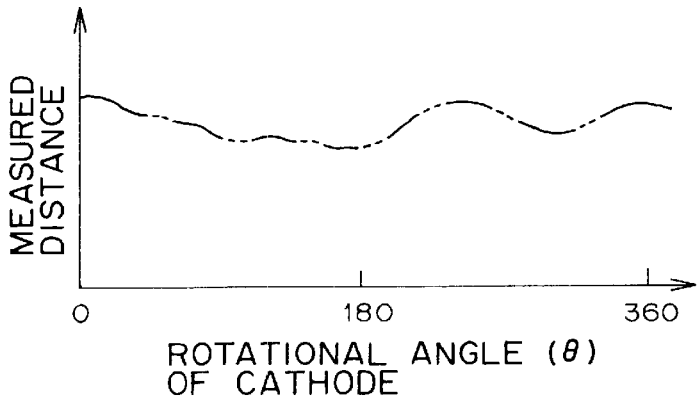
FIG. 6B is a graph showing a change in distance between the other of the two beam apertures and the cathode shown in FIG. 5, wherein the ordinate indicates the distance and the abscissa indicates the rotational angle of the cathode.

FIG. 6B shows one example of the measured results for the beam aperture 8B.

At this time, in an ideal state without any dimensional error, the measured result for the beam aperture 8B shown in FIG. 6B should be 180° offset in phase from the measured result for the beam aperture 8A shown in FIG. 6A.

In an actual state, however, the measured result for the beam aperture 8B is not necessarily 180° offset in phase from the measured result for the beam aperture 8A due to a deviation between the rotational center axis of the receiving member 20 and the center axis of the cathode structure 3 (cathode 1), a flatness of each of the cathode 1 and the first electrode 6, and/or positional accuracies of the assembly (first electrode 6) and the cathode structure 3 (cathode 1) held by the first and second holding portions 15 and 16.

In step S5, a rotational position of the cathode structure 3 including the cathode 1 is set on the basis of the above-described measured results by the control unit 19.

The setting of the rotational position of the cathode structure 3 is performed under a condition that a difference between the distance from the beam aperture 8A of the first electrode 6 to the beam emission plane 1A of the cathode 1 and the distance from the beam aperture 8B of the first electrode 6 to the beam emission plane 1A of the cathode 1 is minimized.

Concretely, the setting of the rotational position of the cathode structure 3 is performed as follows.

Figure 6C:
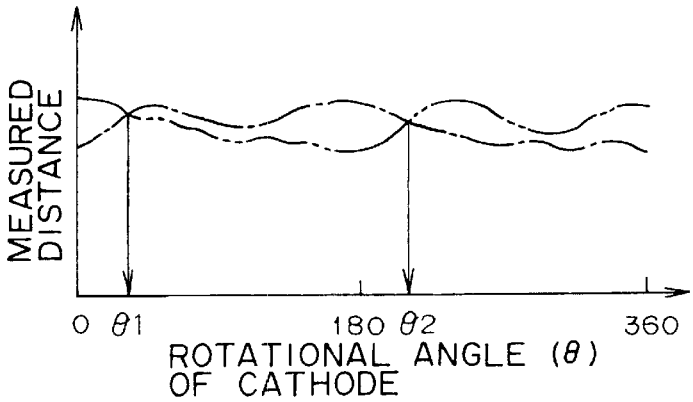
FIG. 6C is a graph obtained by overlapping the graphs shown in FIGS. 6A and 6B to each other, wherein both the graphs shown in FIGS. 6A and 6B cross each other at two rotational angles of the cathode.

First, as shown in FIG. 6C, the measured results for the beam apertures 8A and 8B are overlapped to each other.

At this time, an ideal rotational angle of the cathode 1 can be determined by satisfying the condition that both the measured distances for the beam apertures 8A and 8B correspond to each other at the rotational angle, that is, the distance between both the distances of the beam apertures 8A and 8B becomes zero at the rotational angle.

In the example shown in FIG. 6C, one of the rotational angles θ1 and θ2 of the cathode is selected, as an rotational position to be set, by the control unit 19.

On the basis of the selected rotational angle θ1 or θ2 of the cathode, the motor 17 for rotation is driven by the control unit 19.

The rotational position of the cathode structure 3 including the cathode 1 is thus adjusted under the above-described condition.

Figure 7:
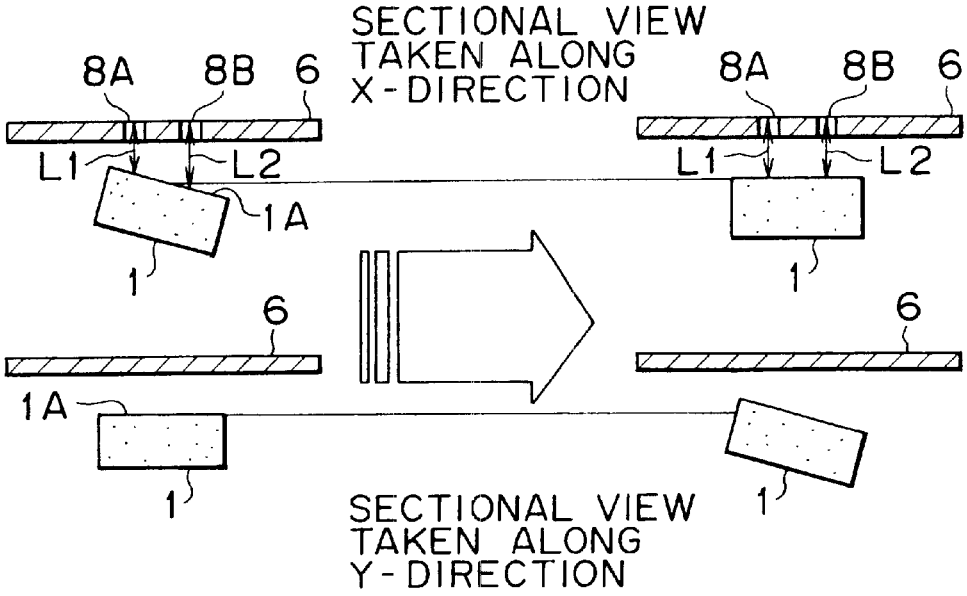
FIG. 7 is a view illustrating arrangement states of the cathode before and after the rotational position of the cathode is optimally set, wherein the cross-section along the X-direction is shown on the upper side and the cross-section along the Y-direction is shown on the lower side; and the state before the rotational position of the cathode is optimally set is shown on the left side and the state after the rotational position of the cathode is optimally set is shown on the right side (shown by an arrow)

FIG. 7 is a sectional view illustrating arrangement states of the cathode 1 before and after the rotational position of the cathode structure is set, wherein the cross-section along the X-direction is shown on the upper side and the cross-section along the Y-direction is shown on the lower side.

As shown in FIG. 7, in the state before the rotational position of the cathode structure 3 is set, there is a difference between a distance L1 from the beam aperture 8A to the beam emission plane 1A and a distance L2 from the beam aperture 8B to the beam emission plane 1A in the cross-section along the X-direction, that is, along the arrangement direction of the beam apertures 8A and 8B.

On the contrary, in the state after the rotational position of the cathode structure 3 is set, the distance L2 from the bean aperture 8B to the beam emission plane 1A becomes substantially equal to the distance L1 from the beam aperture 8A to the beam emission plane 1A in the cross-section along the X-direction, that is, along the arrangement direction of the beam apertures 8A and 8B.

In step S6, the motor 18 for movement up/down is driven by the control unit 19, to adjust the position of the cathode 1 in such a manner that the distance from the beam aperture 8A or 8B of the first electrode 6 to the beam emission plane 1A of the cathode 1, which is substantially equal to the distance from the beam aperture 8B or 8A of the first electrode 6 to the beam emission plane 1A of the cathode 1, corresponds to the above-described reference distance.

In the operation of step S6, the movement amount of the cathode 1 necessary for making the distance between the beam aperture and the beam emission plane correspond to the specified reference distance may be determined on the basis of the measured distance data at the rotational angle θ1 or θ2 of the cathode 1.

Additionally, since the distance between the cathode 1 and the first electrode 6 has been set to be larger than the above-described reference distance, the position of the cathode 1 is adjusted such that the cathode 1 becomes close to the first electrode 6.

In step S7, in the state in which the cathode structure 3 is held by the second holding portion 16, the sleeve 3 is fixed to the sleeve holder 4 by means of fixing means, such as laser welding.

In this way, the positional relationship between the first electrode 6 and the cathode 1 is fixed.

According to the above-described method of assembling an electron gun, in the case of using the first electrode 6 having the two beam apertures 8A and 8B as opposed to one cathode 1, it is possible to make the distance between the beam aperture 8A and the beam emission plane 1A of the cathode 1 equal to the distance between the beam aperture 8B and the beam emission plane 1A of the cathode 1.

As a result, in the electron gun assembled in accordance with the assembling method of the present invention, it is possible to produce electron beams with a high current density without the occurrence of a variation in operational characteristic, and to reduce a drive voltage of the cathode.

Additionally, in the case of using the first electrode 6 having the two beam apertures 8A and 8B as opposed to one cathode 1, the difference between the distance from the beam aperture 8A to the beam emission plane 1A and the distance from the beam aperture 8B to the beam emission plane 1A is minimized at two rotational positions being about 180° separated from each other (at the rotational angles θ1 and θ2 of the cathode 1 in the example shown in FIG. 6C) in the rotational angle range equivalent to one-turn, that is, turn by 360° of the cathode structure 3.

Accordingly, only by acquiring the data of distance measurement in a rotational angle range equivalent to a half of one-turn, that is, turn by 180° of the cathode structure 3, it is possible to determine one of the above-described two rotational angles θ1 and θ2 of the cathode 1.

In the above-described embodiment, the description has been made by example of the electron gun including the first electrode 6 having the two beam apertures 8A and 8B as opposed to one cathode 1; however, the present invention is not limited thereto.

Figure 8A:
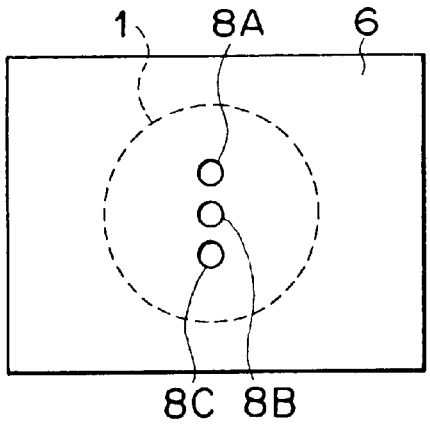
FIG. 8A is a view illustrating an arrangement example in which three beam apertures are provided in a first electrode.
Figure 8B:
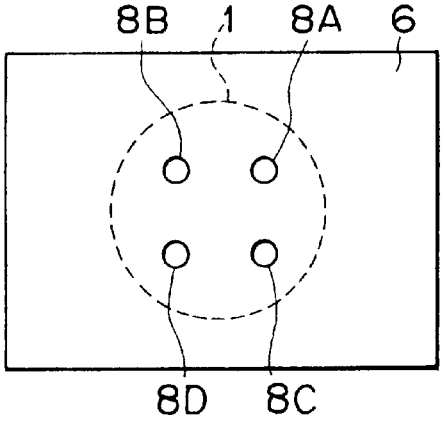
FIG. 8B is a view illustrating an arrangement example in which four beam apertures are provided in a first electrode.

The present invention can be widely applied to an electron gun including a first electrode having a plurality of beam apertures as opposed to one cathode, for example, an electron gun shown in FIG. 8A which includes a first electrode 6 having three beam apertures 8A, 8B, and 8C as opposed to one cathode; an electron gun shown in FIG. 8B which includes a first electrode having four beam apertures 8A, 8B, 8C, and 8D as opposed to one cathode; an electron gun including a first electrode having beam apertures similar in the number to but different in arrangement from those shown in each of FIG. 4 and FIGS. 8A and 8B; and an electron gun including a first electrode having four or more beam apertures as opposed to one cathode.

Figure 9:
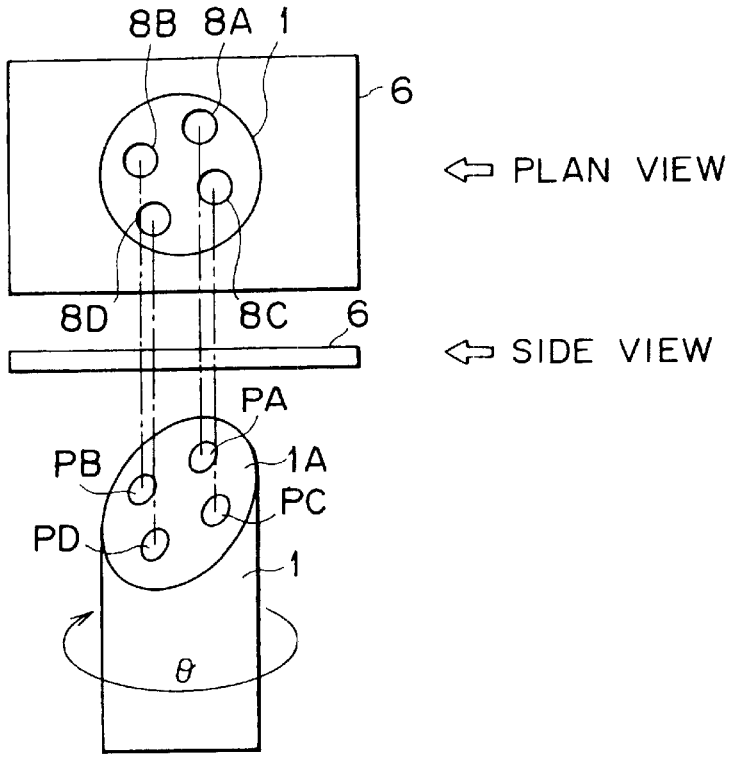
FIG. 9 is a view illustrating an arrangement example used for distance measurement, in which four beam apertures are provided in a first electrode.

FIG. 9 is a conceptual view showing distance measurement for an electron gun including a first electrode having four beam apertures 8A, 8B, 8C, and 8D as opposed to one cathode 1.

In the example shown in FIG. 9, a portion of the upper surface of the first electrode 6 near each of the beam apertures 8A, 8B, 8C, and 8D is taken as a reference point, and the cathode 1 is rotated around on its axis, that is, in the direction θ while irradiating the corresponding one of measurement points PA, PB, PC and PD on a beam emission plane 1A of the cathode 1 with a laser ray having passed through the beam aperture 8A, 8B, 8C, or 8D.

In such a state, a distance between the reference point and each of the measurement points PA, PB, PC, and PD on the beam emission plane 1A is measured in the same manner as described above.

Figure 10:
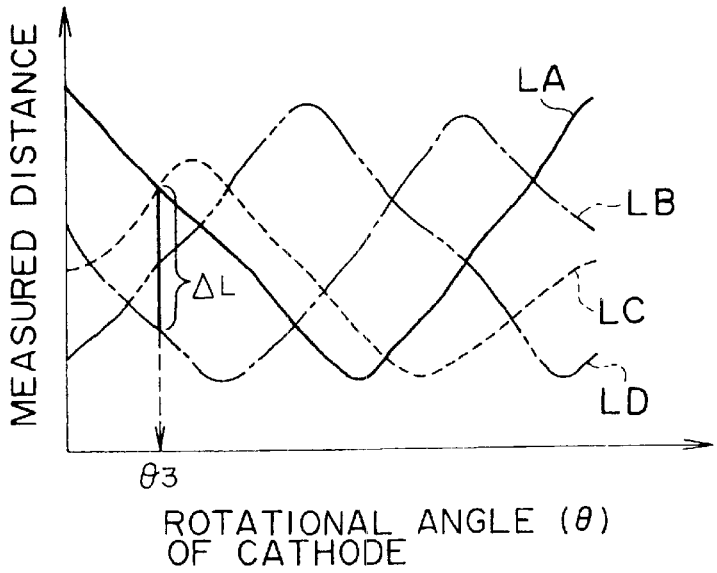
FIG. 10 is a graph showing the results of measuring distances between the four beam apertures and the cathode in the example shown in FIG. 9.

The measured results are shown in FIG. 10.

In the figure, an LA curve shows data obtained by measuring a distance between the reference point and the measurement point PA via the beam aperture 8A at each rotational angle, and an LB curve shows data obtained by measuring a distance between the reference point and the measurement point PB via the beam aperture 8B at each rotational angle.

Further, an LC curve shows data obtained by measuring a distance between the reference point and the measurement point PC via the beam aperture 8C at each rotational angle, and an LD curve shows data obtained by measuring a distance between the reference point and the measurement point PD via the beam aperture 8D at each rotational angle.

As is apparent from the measured results shown in FIG. 10, the maximum one ΔL of differences between the measured distances (LA, LB, LC, and LD) is minimized at a rotational angle θ3 of the cathode 1.

By setting the rotational position of the cathode structure 3 to correspond to the rotational angle θ3 of the cathode 1, the distances between the beam apertures 8A, 8B, 8C, and 8D and the beam emission plane 1A opposed thereto can be equalized.

In the above-described embodiment, the optical measuring means using a laser ray has been used as the measuring means; however, the present invention is not limited thereto.

For example, there may be adopted a method of allowing air to flow between the cathode 1 and the first electrode 6 as objects to be measured, and measuring a distance between the cathode 1 and the first electrode 6 by detecting a micro-change in air flow therebetween; or a method of measuring a distance between the cathode 1 and the first electrode 6 by detecting a micro-change in electrostatic capacity therebetween.

While the preferred embodiment of the present invention has been described using specific terms, such description is for illustrative purposes only, and it is to be understood that changes and variations may be made without departing from the sprit or scope of the following claims.

What is claimed is:

1. An electron gun assembling method used for assembling a first electrode having a plurality of beam apertures as opposed to one cathode used as an electron beam emitting source with a cathode structure having said cathode, said method comprising:

a first step of rotating said cathode structure on its axis in a state in which said cathode structure is opposed to said first electrode, and measuring, during rotation of said cathode structure, a distance between each of said beam apertures of said first electrode and a beam emission plane of said cathode; and a second step of setting a rotational position of said cathode structure on the basis of the result measured in said first step.

2. An electron gun assembling method according to claim 1, wherein in said second step, the rotational position of said cathode structure is set under a condition that the maximum one of the differences between the distances from said beam apertures of said first electrode to the beam emission plane of said cathode is minimized.

3. An electron gun assembling apparatus used for assembling a first electrode having a plurality of beam apertures as opposed to one cathode used as an electron beam emission source with a cathode structure having said cathode, said apparatus comprising:

first holding means for holding said first electrode;

second holding means for holding said cathode structure in a state in which said cathode structure is opposed to said first electrode held by said first holding means;

rotating means for rotating said cathode structure held by said second holding means on its axis;

measuring means for measuring, during rotation of said cathode structure by said rotating means, a distance between each of said beam apertures of said first electrode and a beam emission plane of said cathode; and setting means for setting a rotational position of said cathode structure on the basis of the result measured by said measuring means.

4. An electron gun assembling apparatus according to claim 3, wherein said setting means sets the rotational position of said cathode structure under a condition that the maximum one of the differences between the distances from the beam apertures of said first electrode to the beam emission plane of said cathode is minimized.

* * * * *